US008541340B2

(12) United States Patent
Sawada

(10) Patent No.: US 8,541,340 B2
(45) Date of Patent: Sep. 24, 2013

(54) THERMAL TRANSFER SHEET

(75) Inventor: Masakazu Sawada, Kanagawa (JP)

(73) Assignee: Sony Corporation, Tokyo (JP)

( * ) Notice: Subject to any disclaimer, the term of this patent is extended or adjusted under 35 U.S.C. 154(b) by 453 days.

(21) Appl. No.: 12/633,979

(22) Filed: Dec. 9, 2009

(65) Prior Publication Data

US 2010/0159166 A1 Jun. 24, 2010

(30) Foreign Application Priority Data

Dec. 18, 2008 (JP) ..... 2008-322540

(51) Int. Cl.
*B41M 5/382* (2006.01)

(52) U.S. Cl.
USPC ..... 503/227

(58) Field of Classification Search
None
See application file for complete search history.

(56) References Cited

U.S. PATENT DOCUMENTS 7,732,373 B2 6/2010 Tatewaki et al.

FOREIGN PATENT DOCUMENTS

CN 101041308 A 9/2007
JP HEI 04-269592 A 9/1992
JP 04-329193 11/1992
JP 10-035122 2/1998
JP 2001-080222 A 3/2001

OTHER PUBLICATIONS

Chinese Patent Office Action corresponding to Chinese Serial No. 200910262487 dated Jan. 30, 2011.
Japanese Patent Office, Office Action issued in Patent Application JP 2008-322540, on Nov. 24, 2010.

*Primary Examiner* — Bruce H Hess
(74) *Attorney, Agent, or Firm* — Dentons US LLP

(57) ABSTRACT

A thermal transfer sheet includes a thermal transfer dye layer containing a dye on one surface of a base material sheet and a heat-resistant lubricating layer on the other surface, wherein the heat-resistant lubricating layer contains a compound represented by Chemical formula 1 described below,

[Chemical compound 1]

(Chemical formula 1)

(in the formula, n represents an integer of 15 or more).

3 Claims, 3 Drawing Sheets

THERMAL TRANSFER SHEET

BACKGROUND OF THE INVENTION

1. Field of the Invention

The present invention relates to a thermal transfer sheet, in which a specific fatty acid ester compound is used for a heat-resistant lubricating layer. In particular, the present invention relates to a thermal transfer sheet excellent in running smoothness during transfer and preservation stability of dye.

2. Description of the Related Art

A thermal transfer system by using a sublimation dye transfers a large number of color dots to a transfer receiver through a very short time heating so as to reproduce a full color image based on the color dots of a plurality of colors.

In this thermal transfer system, a so-called sublimation thermal transfer sheet, in which a dye layer composed of a sublimation dye and a binder is disposed on one surface of a base material sheet, e.g., a polyester film, is used as a thermal transfer sheet.

In the thermal transfer system, a thermal transfer sheet is heated from the back with a thermal head in accordance with image information so as to transfer a dye contained in a dye layer to a transfer receiver (photographic paper) and, thereby, form an image.

At this time, regarding the thermal transfer sheet, it is desired that a surface on the side coming into contact with the thermal head stably exhibits low friction over low density image printing to high density image printing. In general, the thermal transfer sheet is provided with a heat-resistant lubricating layer on the surface opposite to the surface, on which the dye layer is disposed, in order to prevent fusion with the thermal head and give smooth running smoothness.

Incidentally, in image printing on the photographic paper by using a thermal transfer sheet, heat is applied to the heat-resistant lubricating layer from the thermal head and, thereby, a dye in the dye layer on the opposite surface is transferred to the photographic paper. The color formation density is proportionate to an amount of heat, and the surface temperature of the thermal head changes by a few hundreds of degrees, correspondingly. Consequently, when the thermal transfer sheet moves on the thermal head, the friction coefficient between the thermal head and the heat-resistant lubricating layer changes easily because of the temperature change. If the friction coefficient between the thermal head and the heat-resistant lubricating layer changes, movement of the thermal transfer sheet at a constant speed becomes difficult and, thereby, it is difficult to obtain a sharp image.

For example, in the case where the friction coefficient between the thermal head and the heat-resistant lubricating layer is large, movement of the thermal transfer sheet becomes slow temporarily, and the density of merely that portion may become high. That is, so-called sticking (linear variations in image printing) may occur.

In order to prevent this sticking, it is desirable that the friction coefficient at, in particular, high temperatures is reduced. As for lubricants to reduce the friction coefficient at high temperatures, phosphate esters and fatty acid esters have been used previously, and the phosphate esters and the fatty acid esters have been contained in the heat-resistant lubricating layers (refer to Japanese Unexamined Patent Application Publication No. 10-35122, for example).

However, the phosphate esters and the fatty acid esters, which are used frequently in general, are volatilized or decomposed by heat from the thermal head so as to stain the thermal head. If image printing is further conducted repeatedly with this stained thermal head, adhered materials are baked on the thermal head surface, and the heat of the thermal head is not conducted to the thermal transfer sheet appropriately because of the baked adhered materials. As a result, variations in image printing and the like occur in the image printing.

Furthermore, in the case where the thermal transfer sheet is preserved in a rolled state, contact between the dye layer and the heat-resistant lubricating layer occurs. Therefore, in particular in a state of high temperature preservation, the phosphate esters and the fatty acid esters having low melting points and high solvency dissolve a part of dye in the dye layer. Consequently, reduction in print image density, variations in image printing, and the like occur in the image printing by using the thermal transfer sheet, from which the dye has been eluted.

As for the lubricant to reduce the friction coefficient, silicone oils are used (refer to Japanese Unexamined Patent Application Publication No. 04-329193, for example).

Regarding the thermal transfer sheet including the silicone oil as well, since the silicone oil is a liquid at ambient temperature, in the case where the thermal transfer sheet is preserved in a rolled state, contact between the dye layer and the heat-resistant lubricating layer occurs, so that a part of dye in the dye layer is eluted. Consequently, reduction in density in the image printing, variations in image printing, and the like occur.

SUMMARY OF THE INVENTION

The present inventor has recognized the above-described circumstances and, therefore, it is desirable to provide a thermal transfer sheet, which is capable of realizing a stable, low friction coefficient in the range of heating temperature through the use of a heating device and which is excellent in preservation stability without staining the heating device nor adversely affecting a thermal transfer dye layer.

According to an embodiment of the present invention, a thermal transfer sheet includes a thermal transfer dye layer containing a dye on one surface of a base material sheet and a heat-resistant lubricating layer on the other surface, wherein the heat-resistant lubricating layer contains a compound represented by Chemical formula 1 described below,

[Chemical compound 1]

(Chemical formula 1)

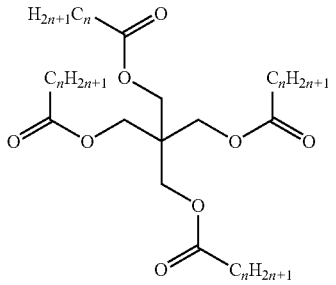

(in the formula, n represents an integer of 15 or more).

According to an embodiment of the present invention, the compound represented by Chemical formula 1 is contained in the heat-resistant lubricating layer. Therefore, excellent lubricity is obtained and a low friction coefficient can be achieved even at high temperatures. Furthermore, according to an embodiment of the present invention, the compound contained in the heat-resistant lubricating layer and represented by Chemical formula 1 has a high melting point and low volatility and is hard to decompose. Consequently, the heating device and the thermal transfer dye layer are not adversely affected and the preservation stability can be improved.

DESCRIPTION OF THE PREFERRED EMBODIMENTS

Preferred embodiments (hereafter referred to as embodiments) of the present invention for executing thermal transfer sheets will be described below in detail with reference to the drawings.

Embodiments (Thermal Transfer Sheet)

Configuration of Thermal Transfer Sheet

Figure 1:
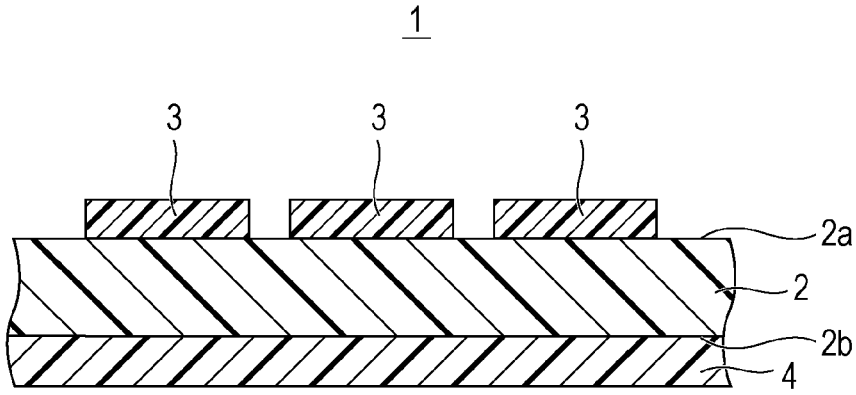
FIG. 1 is a schematic sectional view showing a configuration example of a thermal transfer sheet.

Regarding a thermal transfer sheet 1 according to an embodiment of the present invention, as shown in FIG. 1, thermal transfer dye layers 3 are disposed on one surface 2*a* of a base material sheet 2 and, in addition, a heat-resistant lubricating layer 4 is disposed on a surface 2*b* opposite to the one surface 2*a*.

Base Material Sheet

Various base materials in the related art can be used for the base material sheet 2. For example, polyester films, polystyrene films, polypropylene films, polysulfone films, polycarbonate films, polyimide films, and aramid films can be used. The thickness of this base material sheet 2 is determined at will. For example, the thickness is 1 to 30 μm, and preferably 2 to 10 μm.

The thermal transfer dye layers 3 (may be simply referred to as dye layers 3) are disposed on the surface 2*a* of the above-described base material sheet 2. In the case of monochrome, this thermal transfer dye layers 3 is disposed as a continuous layer on all over the base material sheet 2. Furthermore, in order to respond to an full color image, in general, thermal transfer dye layers 3 of individual colors of yellow, magenta, and cyan are disposed separately and sequentially.

Detection Mark

Figure 2:
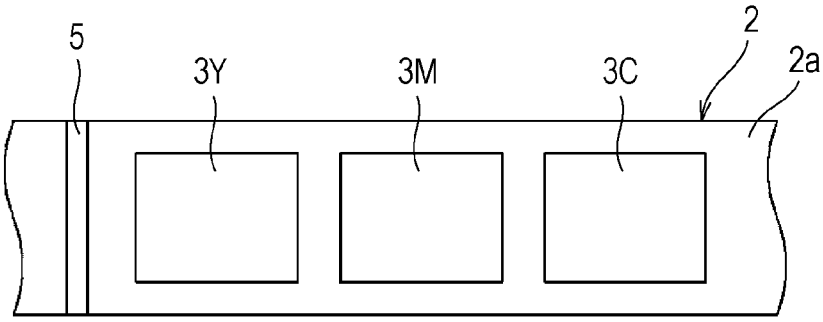
FIG. 2 is a schematic plan view showing a configuration example of a thermal transfer sheet.

FIG. 2 shows an example of thermal transfer sheet 1, on which the detection mark 5 for detecting the position, a yellow dye layer 3Y, a magenta dye layer 3M, and a cyan dye layer 3C are disposed repeatedly.

Figure 3:
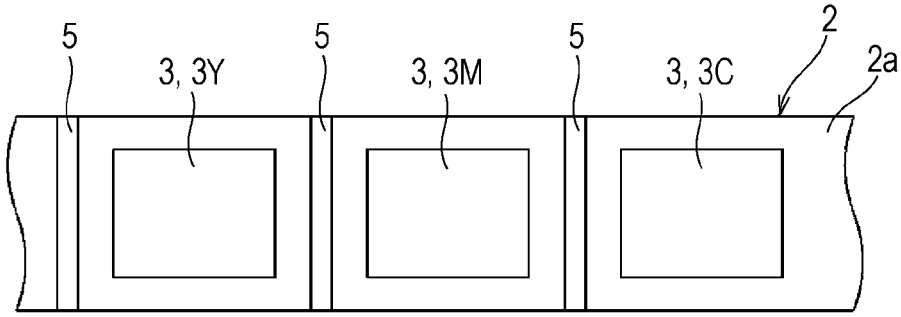
FIG. 3 is a schematic plan view showing an example of a thermal transfer sheet provided with detection marks between individual dyes.

Here, the order of disposition of yellow, magenta, and cyan is not necessarily this order. Furthermore, four colors of yellow, magenta, cyan, and black may be repeated. In addition, as shown in FIG. 3, the detection marks 5 may be disposed between dye layers 3Y, 3M, and 3C of individual colors or between individual dye layers 3 in the case of monochrome.

Transfer Pattern Receiving Layer

Figure 4:
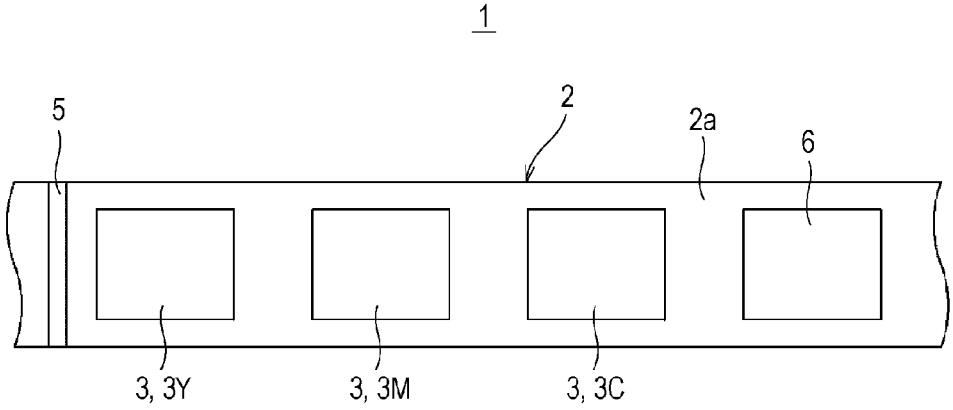
FIG. 4 is a schematic plan view showing an example of a thermal transfer sheet provided with a transfer protective layer.
Figure 5:
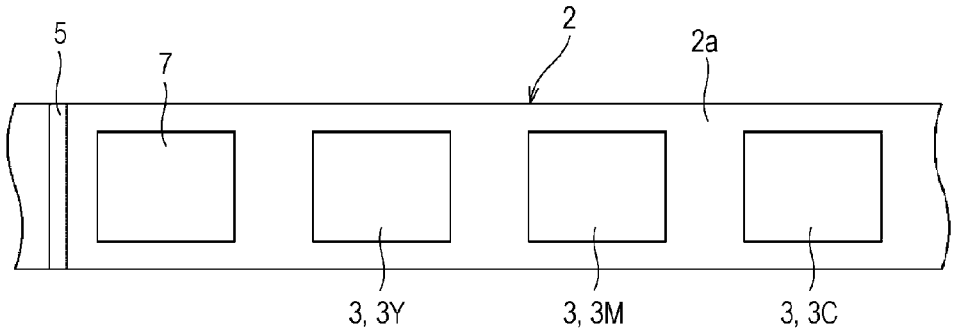
FIG. 5 is a schematic plan view showing an example of a thermal transfer sheet provided with a transfer receiving layer.

Moreover, as shown in FIG. 4, in the case of monochrome dye layers 3, a transfer protective layer 6 may be disposed appropriately between the dye layers 3. In the case where the dye layers 3Y, 3M, and 3C of individual colors are disposed, the dye layers 3Y, 3M, and 3C may be assumed to be one group, and the transfer protective layer 6 may be disposed following the group composed of dye layers 3Y, 3M, and 3C. This transfer protective layer 6 is a transparent protective layer which is transferred to a print image surface after image printing and protects the print image surface. Alternatively, as shown in FIG. 5, a transfer pattern receiving layer 7 to be transferred to the normal paper may be disposed between the monochrome dye layers 3 or toward the front of the group composed of the dye layers 3Y, 3M, and 3C. In the case where the transfer pattern receiving layer is disposed, the transfer pattern receiving layer 7 may be formed on the normal paper surface prior to transfer of the thermal transfer dye layers 3.

Thermal Transfer Dye Layer

The above-described thermal transfer dye layers 3 are formed from at least dyes of individual colors and a binder. Here, binders in the related art can be used for the binder. Examples thereof include organic solvents and water-soluble resins, e.g., water-soluble resins of cellulose base, acrylic acid base, starch base, and the like, acrylic resins, polyphenylene oxide, polysulfone, polyether sulfone, and acetyl cellulose. From the viewpoint of the recording sensitivity and the preservation stability of a thermal transfer sheet 1 (transfer member), binders having heat distortion temperatures of 70° C. to 150° C. are excellent. Therefore, preferable examples include polystyrenes, polyvinylbutyrals, polycarbonates, methacrylic resins, acrylonitrile-styrene copolymers, polyester resins, urethane resins, chlorinated polyethylenes, and chlorinated polypropylenes.

Any dye can be used. For example, as for the yellow dye, azo dyes, disazo dyes, methine dyes, pyridone-azo dyes, and the like and mixtures thereof can be used. As for the magenta dye, azo dyes, anthraquinone dyes, styryl dyes, heterocyclic azo dyes, and mixtures thereof can be used. As for the cyan dyes, indoaniline dyes, anthraquinone dyes, naphthoquinone dyes, heterocyclic azo dyes, and mixtures thereof can be used.

Heat-Resistant Lubricating Layer

On the other hand, the surface 2*b* on the opposite side of the above-described thermal transfer dye layer 3 runs while being in contact with the thermal head and, therefore, is provided with the heat-resistant lubricating layer 4.

This heat-resistant lubricating layer 4 is primarily composed of a binder and contains at least a lubricant.

Any binder in the related art can be used for the binder. For example, cellulose acetates, polyvinyl acetals, and acrylic resins can be used. Furthermore, the binder may be cross-linked with a polyisocyanate compound in consideration of the heat resistance, the stability, and the like.

As for the polyisocyanate compound to be used, any isocyanate compound having at least two isocyanate groups in the molecule can be used. For example, torylene diisocyanate, 4,4'-diphenylmethane diisocyanate, 4,4'-xylene diisocyanate, hexamethylene diisocyanate, 4,4'-methylenebis(cyclohexyl isocyanate), methylcyclohexane-2,4-diisocyanate, methylcyclohexane-2,6-diisocyanate, 1,3-di(methyl isocyanate)cyclohexane, isophorone diisocyanate, trimethylhexamethylene diisocyanate, and the like and adducts (polyisocyanate prepolymers) produced by a partial addition reaction of diisocyanate and polyol, for example, adducts produced by reacting torylene diisocyanate with trimethylol propane, can be used.

Examples of lubricants include compounds (fatty acid ester compounds) represented by Chemical formula 1 described below.

[Chemical compound 2]

(Chemical formula 1)

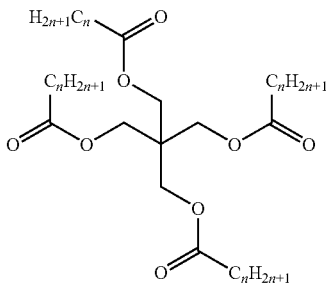

(In the formula, n represents an integer of 15 or more.)

The compound represented by Chemical formula 1 gives the lubricity to the heat-resistant lubricating layer 4 and has a high melting point because n in the formula is specified to be 15 or more. Consequently, even when the thermal transfer sheet 1 is rolled and is preserved in the state in which the thermal transfer dye layers 3 and the heat-resistant lubricating layer 4 are stacked while facing each other, the dyes are not eluted from the thermal transfer dye layers 3(3Y,3M,3C).

It is preferable that the amount of addition of the compound represented by Chemical formula 1 is within the range of 2 to 40 percent by mass relative to the heat-resistant lubricating layer 4. If this amount of addition is specified to be 2 percent by mass or more, a sufficient effect is exerted and a sufficient friction reduction effect is exerted. If the amount is specified to be 40 percent by mass or less, the content of the binder in the heat-resistant lubricating layer 4 does not become too small, the coating film properties can be maintained, and the dye preservation performance is not adversely affected.

Moreover, the compound represented by Chemical formula 1 has a melting point of 59° C. or higher and low volatility and are hard to decompose. If the melting point of the contained compound is about 50° C., in the case where preservation after rolling is conducted in a high-temperature environment, the dyes in the thermal transfer dye layers 3(3Y, 3M,3C) are eluted and the dyes are moved into the heat-resistant lubricating layer 4. In the case where the compound represented by Chemical formula 1 has a melting point of 59° C. or higher and low volatility and is hard to decompose, even when preservation after rolling is conducted in a high-temperature environment, the dyes are not moved into the heat-resistant lubricating layer 4, a reduction in density in the image printing, an occurrence of image printing variations, and the like can be prevented, and staining of the thermal head can be prevented.

Regarding the compound represented by Chemical formula 1, in the case where the site represented by $C_nH_{2n+1}$ in the formula is derived from a naturally occurring substance, the melting point is 59° C. or higher, but variations occur.

The heat-resistant lubricating layer 4 may contain other various lubricants besides the above-described compound represented by Chemical formula 1. Examples of other lubricants include polyglycerin fatty acid esters, phosphate esters, fatty acid esters other than the compounds represented by Chemical formula 1, and fatty acid amides. Among them, phosphate esters are particularly preferably used because an effect of reducing friction of the heat-resistant lubricating layer 4 is exerted.

Furthermore, examples of other lubricants can also include silicone compounds, which have melting points of 59° C. or higher and which are represented by Chemical formula 2 or Chemical formula 3 described below.

[Chemical compound 3]

(Chemical formula 2)

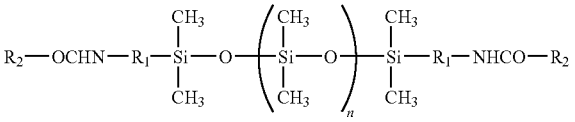

[Chemical compound 4]

(Chemical formula 3)

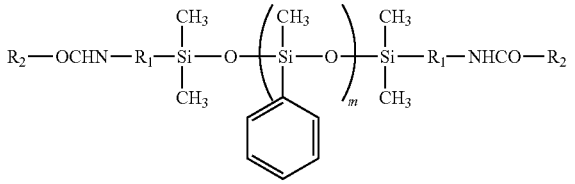

In Chemical formula 2 and Chemical formula 3, $R_1$ contains an alkyl group, an alkylene group, or a phenyl group and may have an ether or ester bond, $R_2$ represents an alkyl group or an alkylene group having the carbon number of 1 to 50, and n and m represent individually an integer of 1 or more, and 200 or less.

Preferably, the amount of addition in the case where other lubricants are mixed is specified in such a way that a total amount of addition of lubricants (a total amount of the compound represented by Chemical formula 1 and the other lubricants) is 50 percent by mass or less in the heat-resistant lubricating layer. If the total amount of addition of the lubricants to the heat-resistant lubricating layer 4 exceeds 50 percent by mass, the proportion of the compound represented by Chemical formula 1 in the whole lubricants is reduced relatively and the friction coefficient on the high-temperature side increases.

Moreover, the heat-resistant lubricating layer 4 may contains, for example, a filler as necessary, besides the binder and the compound represented by Chemical formula 1.

Examples of fillers usable for the heat-resistant lubricating layer 4 include inorganic fillers, e.g., silica, talc, clay, zeolite, titanium oxide, zinc oxide, and carbon, and organic fillers, e.g., silicone resins, Teflon (registered trade mark) resins, and benzoguanamine resins. Here, the silicone resins serving as the filler form unevenness in such a way that a contact surface between the thermal transfer dye layers 3 and the heat-resistant lubricating layer 4 is reduced in preservation after rolling and facilitate the sliding performance. Consequently, the heat-resistant lubricating layer 4 has a reduced contact area with the thermal transfer dye layers 3 even when the thermal transfer sheet 1 is rolled and preserved, so that movement of the dyes can be further suppressed. In addition, since the contact surface with the thermal head is reduced and the sliding performance is facilitated, friction on the thermal head is reduced.

However, if the amounts of addition of them are too large, poor drying may occur in film formation of the heat-resistant lubricating layer 4 and blocking is invited easily in the state of rolling. Therefore, the amounts of addition are controlled appropriately.

Regarding the thermal transfer sheet 1 having the above-described configuration, since the heat-resistant lubricating layer 4 contains at least one type of the compounds represented by Chemical formula 1, the heat-resistant lubricating layer 4 is provided with the lubricity. Consequently, the friction coefficient between the thermal transfer sheet 1 and the thermal head is reduced even in a high-temperature environment, so that the friction coefficient can be stabilized. Furthermore, regarding this thermal transfer sheet 1, the compounds contained in the heat-resistant lubricating layer 4 and represented by Chemical formula 1 have high melting points and low volatility and are hard to decompose. Consequently, regarding the thermal transfer sheet 1, the compounds are not dissolved due to heat, and the thermal head is not stained during image printing. Moreover, regarding the preservation, even when preservation after rolling is conducted in a high-temperature environment, the dyes in the thermal transfer dye layers 3(3Y,3M,3C) are not eluted, the thermal transfer dye layers 3(3Y,3M,3C) are not adversely affected, and excellent preservation stability is exhibited. Therefore, in the case where image printing is conducted by using this thermal transfer sheet 1, the running speed is constant, and the thermal head is not stained, so that the heat is transmitted to the thermal transfer dye layers 3(3Y,3M,3C) appropriately. Furthermore, since elution of the dyes during preservation can be prevented, a reduction in print image density, image printing variations, and the like do not occur, and a high-quality image can be formed.

EXAMPLES

Specific examples according to an embodiment of the present invention will be described below in detail with reference to experimental results. First, the fatty acid ester compound will be described.

Compound 1

Pentaerithritol tetrapalmitate (EXCEPARL PE-TP, produced by Kao Corporation) was used as a compound having the carbon number n of 15 in Chemical formula 1. The melting point of this compound was 67° C.

Compound 2

Pentaerithritol tetrastearate (UNISTER H476, produced by NOF CORPORATION) was used as a compound having the carbon number n of 17 in Chemical formula 1. The melting point of this compound was 60° C. to 65° C.

Thermal transfer sheets were formed through the use of Compounds 1 and 2 described above by the following method.

First, a polyester film (trade name Lumirror, produced by Toray Industries, Ltd.) having a thickness of 6 μm was used as a base material sheet, and one surface thereof was coated with the following ink compositions in such a way that the thickness became 1 μm after drying, followed by drying.

| Yellow ink | |
|---|---|
| Foron Yellow (produced by Sandoz K.K.) | 5.0 parts by weight |
| Polyvinyl butyral resin (trade name BX-1, produced by Sekisui Chemical Co., Ltd.) | 5.0 parts by weight |
| Methyl ethyl ketone | 45.0 parts by weight |
| Toluene | 45.0 parts by weight |

| Magenta ink | |
|---|---|
| Foron red | 2.5 parts by weight |
| Anthraquinone dye (trade name ESC451, produced by Sumitomo Chemical Co., Ltd.) | 2.5 parts by weight |
| Polyvinyl butyral resin (trade name BX-1, produced by Sekisui Chemical Co., Ltd.) | 5.0 parts by weight |
| Methyl ethyl ketone | 45.0 parts by weight |
| Toluene | 45.0 parts by weight |

| Cyan ink | |
|---|---|
| Foron Blue (produced by Sandoz K.K.) | 2.5 parts by weight |
| Indoaniline dye (structural formula is shown as Chemical formula 4 described below) | 2.5 parts by weight |
| Polyvinyl butyral resin (trade name BX-l, produced by Sekisui Chemical Co., Ltd.) | 5.0 parts by weight |
| Methyl ethyl ketone | 45.0 parts by weight |
| Toluene | 45.0 parts by weight |

[Chemical compound 5]

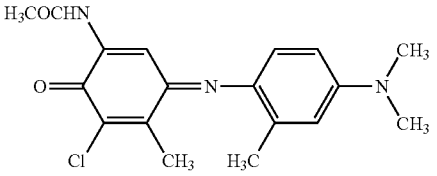

(Chemical formula 4)

Next, a surface of the base material sheet opposite to the surface coated with the thermal transfer dye layers was coated with a heat-resistant lubricating layer composed of the following composition in such a way that the thickness became 0.5 μm after drying and, thereby, thermal transfer sheets of Example 1 to Example 14 were obtained.

Example 1 to Example 14

| Composition of heat-resistant lubricating layer | |
|---|---|
| Polyacetal resin (trade name DENKA BUTYRAL #3000K, produced by DENKI KAGAKU KOGYO K.K.) | 100 parts by weight |
| Polyisocyanate (trade name Coronate L, NIPPON POLYURETHANE INDUSTRY CO., LTD., 45 percent by weight, the remainder is 55 percent by weight of ethyl acetate serving as an organic solvent) | 20 parts by weight |
| Spherical silica (TOSPEARL XC99, produced by Toshiba Silicone Co., Ltd.) | 3 parts by weight |
| Organic solvent (methyl ethyl ketone:toluene = 1:3) | 1,900 parts by weight |

The types and the amounts of addition of Compound 1, silicone compound, phosphate esters, and the like serving as lubricants are shown in Table 1 described below. In this connection, percent by mass in Table 1 indicates the proportion of the mass of the lubricants contained in the heat-resistant lubricating layer after formation.

TABLE 1

| | Lubricant | Mass in layer (%) | Parts by weight |
|---|---|---|---|
| Example 1 | Compound 1 | 2.5 | 3 |
| Example 2 | Compound 1 | 15 | 20 |
| Example 3 | Compound 1 | 40 | 76 |
| Example 4 | Compound 1 | 7.5 | 10 |
| | phosphate ester | 7.5 | 10 |
| Example 5 | Compound 1 | 11 | 15 |
| | phosphate ester | 7.3 | 10 |
| Example 6 | Compound 1 | 14 | 20 |
| | phosphate ester | 7.0 | 10 |
| Example 7 | Compound 1 | 34 | 65 |
| | phosphate ester | 7.8 | 15 |
| Example 8 | Compound 2 | 2.5 | 3 |
| Example 9 | Compound 2 | 15 | 20 |
| Example 10 | Compound 2 | 40 | 76 |
| Example 11 | Compound 2 | 7.5 | 10 |
| | phosphate ester | 7.5 | 10 |
| Example 12 | Compound 2 | 11 | 15 |
| | phosphate ester | 7.3 | 10 |
| Example 13 | Compound 2 | 14 | 20 |
| | phosphate ester | 7.0 | 10 |
| Example 14 | Compound 2 | 34 | 65 |
| | phosphate ester | 7.8 | 15 |
| Comparative example 1 | myristic acid | 15 | 20 |
| Comparative example 2 | butyl stearate | 15 | 20 |
| Comparative example 3 | hexaglyceryl pentastearate | 15 | 20 |
| Comparative example 4 | phosphate ester | 15 | 20 |
| Comparative example 5 | silicone oil | 15 | 20 |
| Comparative example 6 | Compound 1 | 1.7 | 2 |
| Comparative example 7 | Compound 1 | 45 | 90 |
| Comparative example 8 | Compound 1 | 28 | 65 |
| | phosphate ester | 24 | 55 |
| Comparative example 9 | Compound 2 | 1.7 | 2 |
| Comparative example 10 | Compound 2 | 45 | 90 |
| Comparative example 11 | Compound 2 | 28 | 65 |
| | phosphate ester | 24 | 55 |

In this connection, the phosphate ester used here was a trade name PHOSPHANOL RL-210 produced by TOHO Chemical Industry Co., Ltd.

Comparative Example 1 to Comparative Example 11

In Comparative example 1 to Comparative example 11, a surface of the base material sheet opposite to the surface coated with the thermal transfer dye layers was coated with a heat-resistant lubricating layer composed of the following composition in such a way that the thickness became 0.5 μm after drying in a manner similar to that in Example 1 to Example 14 and, thereby, thermal transfer sheets were obtained.

| Composition of heat-resistant lubricating layer | |
|---|---|
| Polyacetal resin (trade name DENKA BUTYRAL #3000K, produced by DENKI KAGAKU KOGYO K.K.) | 100 parts by weight |
| Polyisocyanate (trade name Coronate L, produced by NIPPON POLYURETHANE INDUSTRY CO., LTD.) | 20 parts by weight |
| Spherical silica (TOSPEARL XC99, produced by Toshiba Silicone Co., Ltd.) | 3 parts by weight |
| Organic solvent (methyl ethyl ketone:toluene = 1:3) | 1,900 parts by weight |

As for lubricants in Comparative examples, myristic acid (LUNAC MY-98, produced by Kao Corporation), butyl stearate (NIKKOL BS, produced by Nikko Chemicals Co., Ltd.), hexaglyceryl pentastearate (trade name NIKKOL HEXAGLYN-5S, produced by Nikko Chemicals Co., Ltd.), phosphate ester (trade name PHOSPHANOL RL-210, produced by TOHO Chemical Industry Co., Ltd.), and silicone oil (trade name FM-4425, produced by Chisso Corporation) were added and mixed at proportions shown in Table 1 and, thereby, thermal transfer sheets were prepared in a manner similar to that in Example 1 to Example 14.

Figure 6:
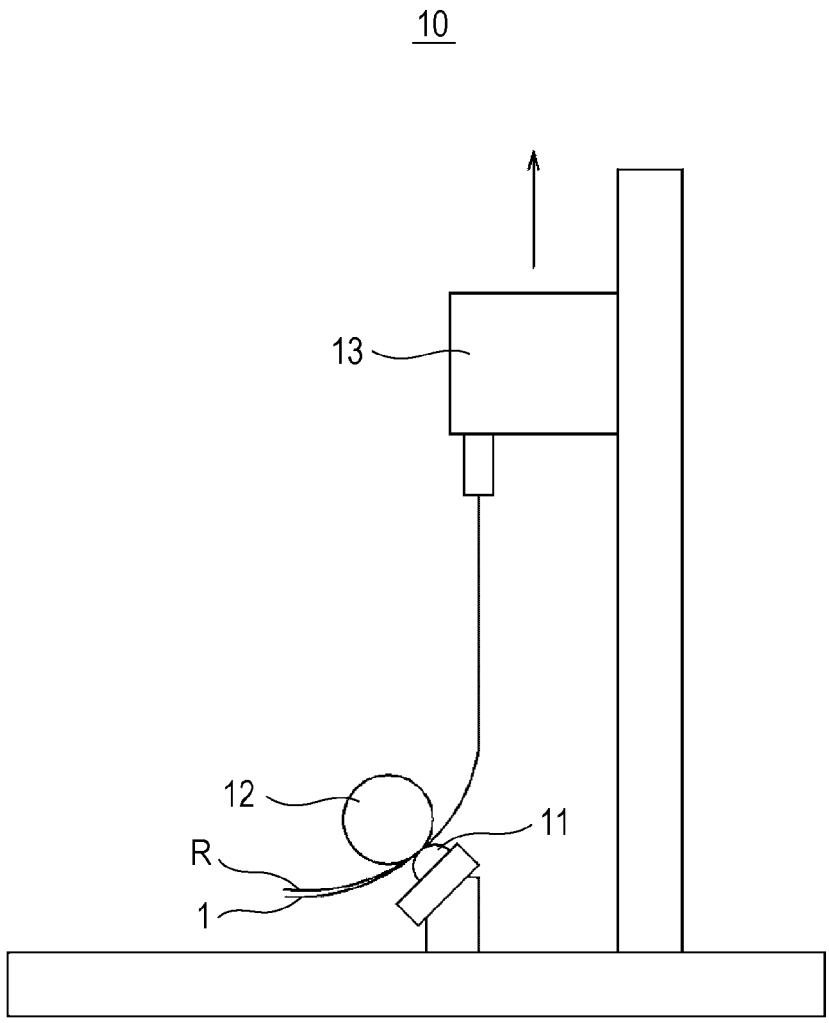
FIG. 6 is a schematic diagram showing the rough configuration of a friction measuring apparatus.

Regarding these thermal transfer sheets formed in Examples and Comparative examples, the friction coefficient, the running smoothness, the sticking, the dye preservation performance, and the thermal head staining resistance were measured. The friction coefficient was measured by using a friction measuring apparatus 10 shown in FIG. 6. Regarding this friction measuring apparatus 10, a thermal transfer sheet 1 and photographic paper R are sandwiched between a thermal head 11 and a platen roll 12, the thermal transfer sheet 1 and the photographic paper R are pulled up with a tension gauge 13 and, thereby, a tension is measured. The measurement condition is as described below.

Measurement Condition

Thermal transfer sheet feed speed: 450 mm/min
Signal setting
Print pattern: 2 (Stair Step)
Original: 3 (48/672 lines, 14 steps)
Strobe division: 1
Strobe pulse width: 20.0 msec
Printing speed: 22.0 msec/1 line
Clock: 3 (4 MHz)
Head voltage: 18.0 V Furthermore, the running smoothness, the sticking, and the thermal head staining resistance were evaluated by using the following methods. That is, the resulting thermal transfer sheet was mounted on a full color printer (trade name UP-D7000) produced by Sony Corporation, and gray-scale image printing (with a 16-step gradation) was conducted on photographic paper (trade name UPC7010 produced by Sony Corporation). The running smoothness (variations in image printing, wrinkle generation, and deviation in image printing) and the sticking were checked visually.

Regarding the running smoothness, a symbol ⊙ indicates that the result was good, and a symbol x indicates that wrinkles and the like were generated. Regarding the sticking, the symbol ⊙ indicates that no sticking occurred, and the symbol x indicates that sticking occurred.

Regarding the thermal head staining resistance, gray-scale image printing was repeated 5,000 times and, thereafter, the thermal head surface was observed with an optical microscope. The symbol ⊙ indicates that the result was good, and the symbol x indicates that adhered materials were observed and, therefore, staining occurred.

Moreover, regarding the dye preservation performance, the resulting two thermal transfer sheets (20 cm×20 cm) were stacked in such a way that the thermal transfer dye layers of one sheet faced the heat-resistant lubricating layer of the other sheet. The two sheets were sandwiched between two glass plates, a load was applied from above with a 5-kg weight, and preservation was conducted in an oven at 50° C. for 48 hours. The thermal transfer sheets before and after the preservation were mounted on the full color printer (trade name UP-D7000) produced by Sony Corporation, and gray-scale image printing (with a 16-step gradation) was conducted on photographic paper (trade name UPC7010 produced by Sony Corporation). A maximum density of each color was measured by a reflection density measurement with Macbeth densitometer (trade name TR-924). The dye preservation performance was evaluated on the basis of a calculation result of (maximum density after preservation/maximum density before preservation)×100(%). The evaluation results are shown in Table 2 described below.

TABLE 2

| | Friction coefficient (min) | Friction coefficient (max) | Running smoothness | Sticking | Dye preservation performance (%) | Thermal head staining resistance |
|---|---|---|---|---|---|---|
| Example 1 | 0.20 | 0.23 | ⊙ | ⊙ | 100 | ⊙ |
| Example 2 | 0.18 | 0.20 | ⊙ | ⊙ | 100 | ⊙ |
| Example 3 | 0.17 | 0.22 | ⊙ | ⊙ | 94 | ⊙ |
| Example 4 | 0.16 | 0.20 | ⊙ | ⊙ | 99 | ⊙ |
| Example 5 | 0.15 | 0.19 | ⊙ | ⊙ | 97 | ⊙ |
| Example 6 | 0.15 | 0.18 | ⊙ | ⊙ | 95 | ⊙ |
| Example 7 | 0.17 | 0.22 | ⊙ | ⊙ | 90 | ⊙ |
| Example 8 | 0.19 | 0.23 | ⊙ | ⊙ | 100 | ⊙ |
| Example 9 | 0.17 | 0.20 | ⊙ | ⊙ | 100 | ⊙ |
| Example 10 | 0.16 | 0.21 | ⊙ | ⊙ | 91 | ⊙ |
| Example 11 | 0.16 | 0.22 | ⊙ | ⊙ | 97 | ⊙ |
| Example 12 | 0.15 | 0.19 | ⊙ | ⊙ | 95 | ⊙ |
| Example 13 | 0.15 | 0.18 | ⊙ | ⊙ | 93 | ⊙ |
| Example 14 | 0.17 | 0.21 | ⊙ | ⊙ | 90 | ⊙ |
| Comparative example 1 | 0.21 | 0.26 | ⊙ | ⊙ | 97 | X |
| Comparative example 2 | 0.20 | 0.25 | ⊙ | ⊙ | 99 | X |
| Comparative example 3 | 0.19 | 0.25 | ⊙ | ⊙ | 100 | X |
| Comparative example 4 | 0.17 | 0.25 | ⊙ | ⊙ | 85 | ⊙ |
| Comparative example 5 | 0.14 | 0.17 | ⊙ | ⊙ | 70 | X |
| Comparative example 6 | 0.22 | 0.30 | X | X | 100 | ⊙ |
| Comparative example 7 | 0.17 | 0.24 | ⊙ | ⊙ | 88 | ⊙ |
| Comparative example 8 | 0.16 | 0.19 | ⊙ | ⊙ | 55 | X |
| Comparative example 9 | 0.22 | 0.32 | X | X | 100 | ⊙ |
| Comparative example 10 | 0.17 | 0.26 | ⊙ | ⊙ | 85 | ⊙ |
| Comparative example 11 | 0.17 | 0.21 | ⊙ | ⊙ | 50 | X |

As is clear from the results shown in Table 2, regarding all of Example 1 to Example 14 in which Compound 1 and Compound 2 represented by Chemical formula 1 were contained in the heat-resistant lubricating layer, the running smoothness was good, sticking along with an increase in friction was not observed, and sharp images were obtained. Furthermore, regarding Example 1 to Example 14, the dye preservation performance of 90% or more was achieved and, therefore, there was substantially no problem in practical use. Moreover, as a result of observation of the thermal heads in Example 1 to Example 14, substantially no staining of thermal head surface occurred, repetition of image printing was substantially not affected and, therefore, good images were obtained.

On the other hand, regarding Comparative example 1 to Comparative example 3 in which the fatty acid and the fatty acid esters were used, as a result of observation of the thermal heads, there were adhered materials on the thermal head surfaces and, therefore, staining of thermal heads occurred.

In Comparative example 4 in which phosphate ester was used alone, regarding the dye preservation performance, a significant reduction in the density after the preservation was observed and, therefore, a satisfactory result was not obtained.

In Comparative example 5 in which the silicone oil was used, a film having a small friction coefficient was able to be obtained. However, regarding the dye preservation performance, a significant reduction in the density after the preservation was observed and, therefore, a satisfactory result was not obtained. Moreover, as a result of observation of the thermal head in Comparative example 5, there was adhesion of oil on the thermal head surface and, therefore, staining of thermal head occurred.

In addition, in Comparative examples 6 and 9, sufficient friction coefficients were not obtained because the amounts of the Compound 1 and Compound 2 represented by Chemical formula 1 were small. In Comparative examples 7 and 10, the friction coefficients resulted in small values, but the dye preservation performance deteriorated. Furthermore, in Comparative examples 8 and 11 as well, the friction coefficients resulted in small values, but the dye preservation performance deteriorated. Moreover, as a result of observation of the thermal heads, there was adhesion of oil-like substances and, therefore, staining of thermal heads occurred.

As described above, it is clear that in the case where the heat-resistant lubricating layer of the thermal transfer sheet contains a compound represented by Chemical formula 1, the friction coefficient between the thermal head and the thermal transfer sheet can be reduced, good running smoothness is exhibited, sticking can be prevented, good dye preservation performance is exhibited, the staining of the thermal head can be prevented and, therefore, a good image can be obtained.

The present application contains subject matter related to that disclosed in Japanese Priority Patent Application JP 2008-322540 filed in the Japan Patent Office on Dec. 18, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal transfer sheet comprising:

a thermal transfer dye layer containing a dye on one surface of a base material sheet; and a heat-resistant lubricating layer on the other surface, wherein, the heat-resistant lubricating layer contains a compound represented by Chemical formula 1:

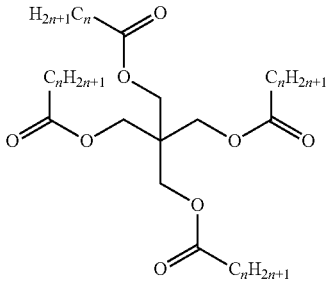

where, n represents an integer of 15 or more, and the amount of the compound represented by Chemical formula 1 is 2 percent by mass to 40 percent by mass inclusive in the heat-resistant lubricating layer.

2. The thermal transfer sheet according to claim 1, wherein the heat-resistant lubricating layer comprises the compound represented by Chemical formula 1 and a phosphate ester.

3. The thermal transfer sheet according to claim 2, wherein a total content of the compound represented by Chemical formula 1 and the phosphate ester is 50 percent by mass or less in the heat-resistant lubricating layer.

* * * * *